United States Patent [19]

Myer et al.

[11] Patent Number: 4,963,098

[45] Date of Patent: Oct. 16, 1990

[54] BLIND MATE SHIELDED INPUT/OUTPUT CONNECTOR ASSEMBLY

[75] Inventors: John M. Myer, Millersville; Richard W. Grzybowski, Lebanon, both of Pa.; Thomas J. Kane, Dearborn, Mich.

[73] Assignee: AMP Incorporated, Harrisburg, Pa.

[21] Appl. No.: 397,350

[22] Filed: Aug. 24, 1989

Related U.S. Application Data

[63] Continuation of Ser. No. 317,037, Mar. 1, 1989, abandoned, which is a continuation of Ser. No. 161,067, Feb. 26, 1988, abandoned.

[51] Int. Cl.[5] ..... H01R 13/629; H01R 13/514

[52] U.S. Cl. ..... 439/76; 439/248; 439/620; 439/715; 439/686; 439/378

[58] Field of Search ..... 439/76, 79, 247, 248, 439/378–381, 545, 610, 620, 650, 686, 690, 695, 697, 712–716, 902

[56] References Cited

U.S. PATENT DOCUMENTS

| | | | |
|---|---|---|---|
| 3,488,623 | 1/1970 | Stephenson et al. | 439/248 |
| 3,744,128 | 7/1973 | Fisher et al. | 29/629 |
| 3,873,172 | 3/1975 | Paullus | 339/17 F |
| 4,063,683 | 12/1977 | Jones . | |
| 4,083,620 | 4/1978 | Burgin | 248/203 |
| 4,179,178 | 12/1979 | Bachman et al. | 339/111 |
| 4,275,945 | 6/1981 | Krantz et al. | 339/147 R |
| 4,381,878 | 5/1983 | Lechner et al. | 339/14 R |
| 4,392,700 | 7/1983 | Showman et al. | 439/378 |
| 4,418,975 | 12/1983 | O'Keefe, II . | |
| 4,508,404 | 4/1985 | Frawley | 339/45 M |
| 4,509,258 | 4/1985 | Locati et al. | 29/876 |
| 4,602,317 | 7/1986 | Rovnyak et al. | 361/413 |
| 4,647,130 | 3/1987 | Blair et al. . | |
| 4,653,837 | 3/1987 | Phillipson et al. | 339/143 R |
| 4,655,525 | 4/1987 | Hunt, III et al. . | |
| 4,664,456 | 5/1987 | Blair et al. | 339/14 P |
| 4,682,833 | 7/1987 | Ferchau et al. | 439/377 |
| 4,687,267 | 8/1987 | Header et al. | 439/62 |
| 4,722,691 | 2/1988 | Gladd et al. | 439/76 |
| 4,722,704 | 2/1988 | VanDerStuyf et al. | 439/851 |
| 4,725,249 | 2/1988 | Blackwood et al. | 439/535 |
| 4,756,695 | 7/1988 | Lane et al. | 439/76 |
| 4,761,144 | 8/1988 | Hunt, III et al. | 439/545 |

FOREIGN PATENT DOCUMENTS

| | | |
|---|---|---|
| 8701689 | 2/1987 | Fed. Rep. of Germany . |
| 2489609 | 3/1982 | France . |

OTHER PUBLICATIONS

AMP Incorporated IS Sheet 9163 (11-19-86) "AMP* High-Durability Drawer Connectors (HDDC)".

AMP Catalog 76-362 (Rev. 9-83) "Metrimate Pin and Socket Connectors".

*Primary Examiner*—Gary F. Paumen

*Attorney, Agent, or Firm*—Robert W. Pitts

[57] ABSTRACT

A blind mate shielded input/output connector assembly is disclosed for use in the robotic assembly of an electrical component, such as a radio, to electrical conductors, such as electrical wires in a harness in an automobile. The connector assembly includes a header which can be fixedly mounted to the electrical component and which includes an alignment post protruding beyond printed circuit board pins located in the header. A receptacle module includes cavities for receiving multi-contact electrical connectors and an alignment cavity into which the alignment post can be inserted. The receptacle module is mounted to a carrier panel beyond which conductors in the harness extend so that the receptacle module can move in any direction within the plane of the panel, thus permitting alignment during straight line movement of the header toward the panel. The receptacle module can also be used to provide EMI shielding and a filter can be mounted in the header.

29 Claims, 8 Drawing Sheets

BLIND MATE SHIELDED INPUT/OUTPUT CONNECTOR ASSEMBLY

This application is a Continuation of application Ser. No. 07/317,037 filed Mar. 1, 1989, now abandoned, in turn, a Continuation of application Ser. No. 07/161,067 filed Feb. 26, 1988, now abandoned.

BACKGROUND OF THE INVENTION

1. Field of the Invention

This invention relates to a connector assembly of the type suitable for connecting a multiconductor cable to a plurality of circuits in an electrical component and more particularly relates to a connector assembly consisting of a header mounted on the outer portion of the component having a plurality of pins commoned to a printed circuit board and to a matable connector assembly consisting of electrical connectors attached to the conductors in the multiconductor cable and a receptacle module engagable with the header. In particular, this invention relates to a connector assembly in which the components can be blind mated to the cable, for example an assembly in which an electrical component, such as a dash mounted, radio, could be blind mated to an electrical harness located behind the carrier panel in the dash of an automobile.

2. Description of the Prior Art

Electrical components, such as radios, are normally hand assembled into the dash or other components of an automobile. An electrical harness mounted behind panels in the automobile having electrical connectors at appropriate locations is normally positioned in the automobile. When the separate components, such as the radio, are to be attached to the harness, the separate connectors at the end of the harness are conventionally inserted into mating connectos or headers on the rear of the component, and the component is then mounted to a panel or to the frame in the automobile. This operation will, of course, require slack to permit hand assembly of the connectors at the rear of the component prior to mounting and can be quite labor intensive.

One conventional radio assembly used in automobiles and shown in the prior art drawing of FIG. 1 employs a molded insulated connector or header mounted to a printed circuit board on the exterior of a radio case. The exterior printed circuit board is, in turn, connected to a printed circuit board on the interior of the case through a separate ribbon cable. This assembly does not permit a simple blind mate operation for electrically interconnecting the radio to the wire harness as the radio is mounted in the dash.

U.S. Pat. No. 4,418,975 does disclose a slid-in dash mounted radio which can be attached to a plurality of electrical connectors at one location for interconnection to remotely located components such as an electrical power source in the engine compartment and speakers at various locations in the passenger compartment. The assembly shown in that patent has a plurality of connectors arranged and located at the side of a receptacle for receiving the radio case. A terminal block, located on the side of the radio case, engages these connectors when the radio is inserted into a recess on the automobile dash.

SUMMARY OF THE INVENTION

The preferred embodiment of this invention comprises an assembly for mounting an electrical component, such as a radio, on a panel and connecting the electrical component to electrical conductors, such as wires in a harness, behind the panel upon movement of the electrical component in a straight line toward the panel. Such an assembly is especially useful for robotically assembling an electrical component, such as a radio, to a harness in an automobile. The assembly includes two mating housings, one of which is mounted in the panel for at least limited movement in any direction in the plane of the panel. The housing mounted in the panel has an electrical connector attached thereto or inserted therein. Terminals in the electrical connector are matable with terminals in the mating housing. Alignment of the first and second housings in the plane of the panel occurs during movement of the first housing in a straight line toward the panel. A protruding alignment post is received within a mating alignment cavity to mutually position the first and second housings and to align corresponding terminals prior to mating engagement of the terminals. The protruding end of the alignment post is tapered around the periphery for engagement with a beveled lead-in portion of the alignment post. In the preferred embodiment of this invention, the housing attached to the electrical component comprises a header having a plurality of electrically conductive pins mounted in an insulative body. The alignment post protrudes from the header and, in the preferred embodiment, is located between rows of pins. The second housing comprises a receptacle module having at least one connector mounting cavity for receiving the electrical connector upon insertion from the rear. The alignment cavity extends from the front face of the receptacle module.

This connector assembly comprises a blind mate input/output electrical connector assembly. A cover can be assembled to the rear of the receptacle module and, by employing a suitable plating or a suitable filler within the receptacle module and the cover, the connector and cables within the receptacle/cover assembly can be shielded from electromagnetic interference. A filter can also be mounted on the header inside the case of the electrical component.

BRIEF DESCRIPTION OF THE DRAWINGS

FIG. 3 is a perspective view showing two multiconductor electrical connectors mounted in cavities within the receptacle module.

FIG. 5 is a section view of the receptacle module showing one multiconductor connector received within a mounting cavity and one mounting empty cavity and a section view of a mating header pin.

FIG. 9 is a perspective view of the connector assembly.

DETAILED DESCRIPTION OF THE PREFERRED EMBODIMENT

Figure 1:
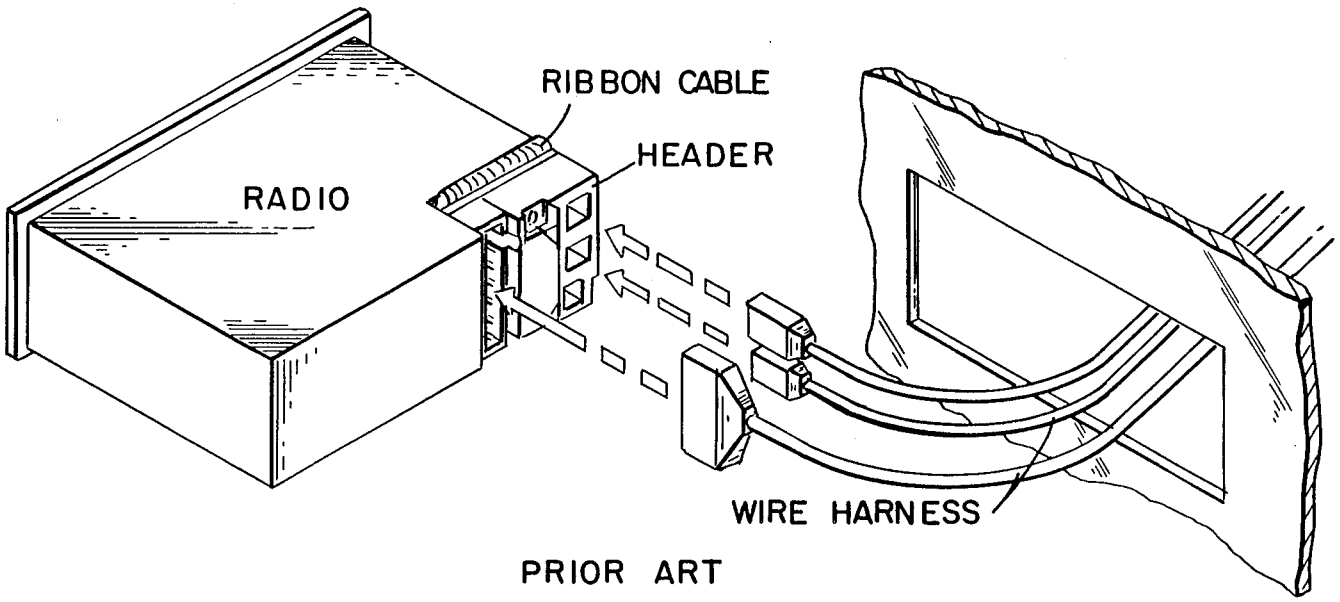
PRIOR ART FIG. 1
FIG. 1 is a view of a prior art mounting and electrical interconnection assembly which cannot be blind mated.
Figures 2, 2A:
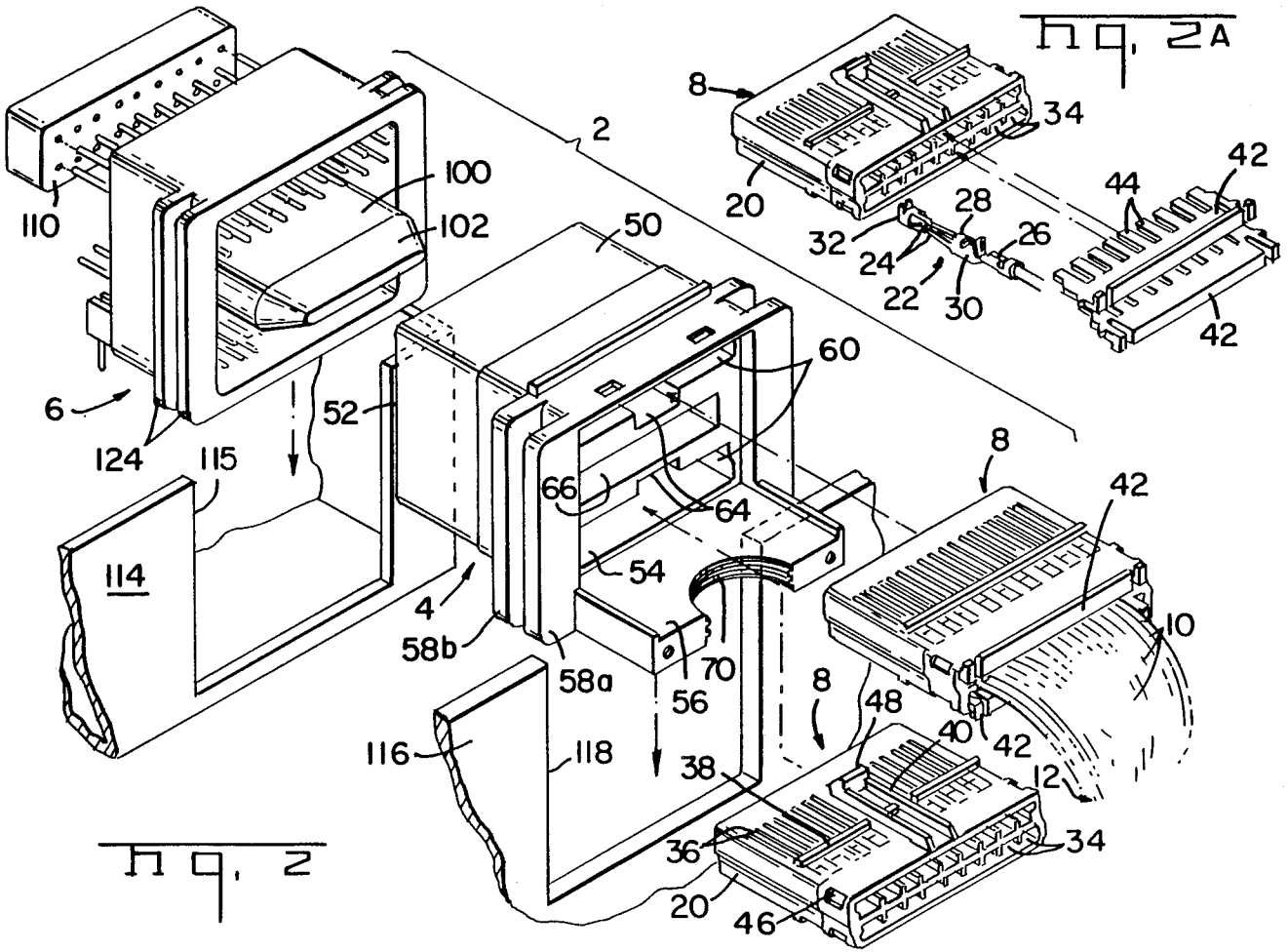
FIG. 2 is an exploded perspective view of the connector assembly showing two multiconductor electrical connectors attached in wires in a cable harness, a receptacle module, and a mating header.
FIG. 2A is a perspective exploded view of a multiconductor electrical connector, a terminal and secondary locks.
Figure 7:
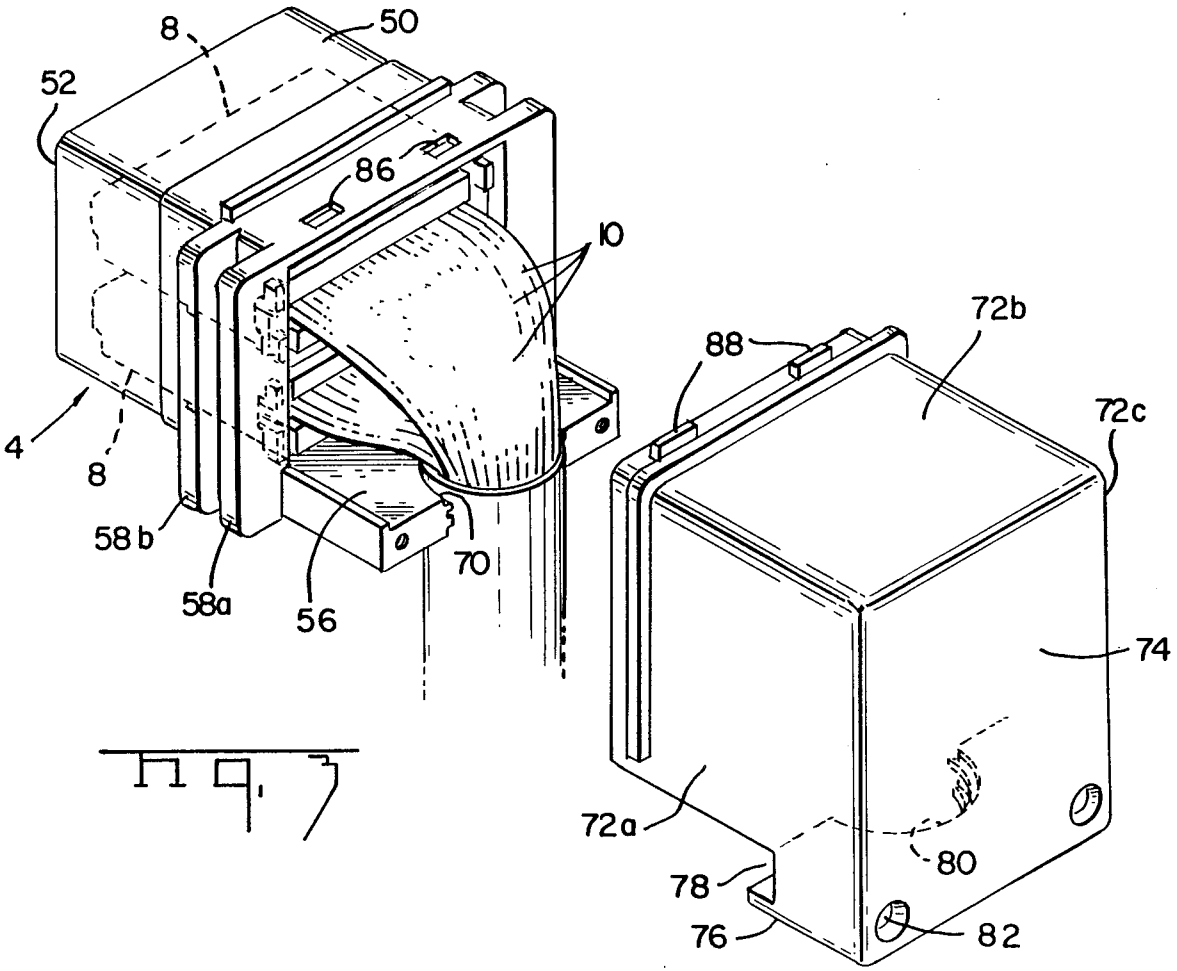
FIGS. 7 and 8 are schematic views showing diagonal movement of the receptacle module during blind mating.
Figure 4:
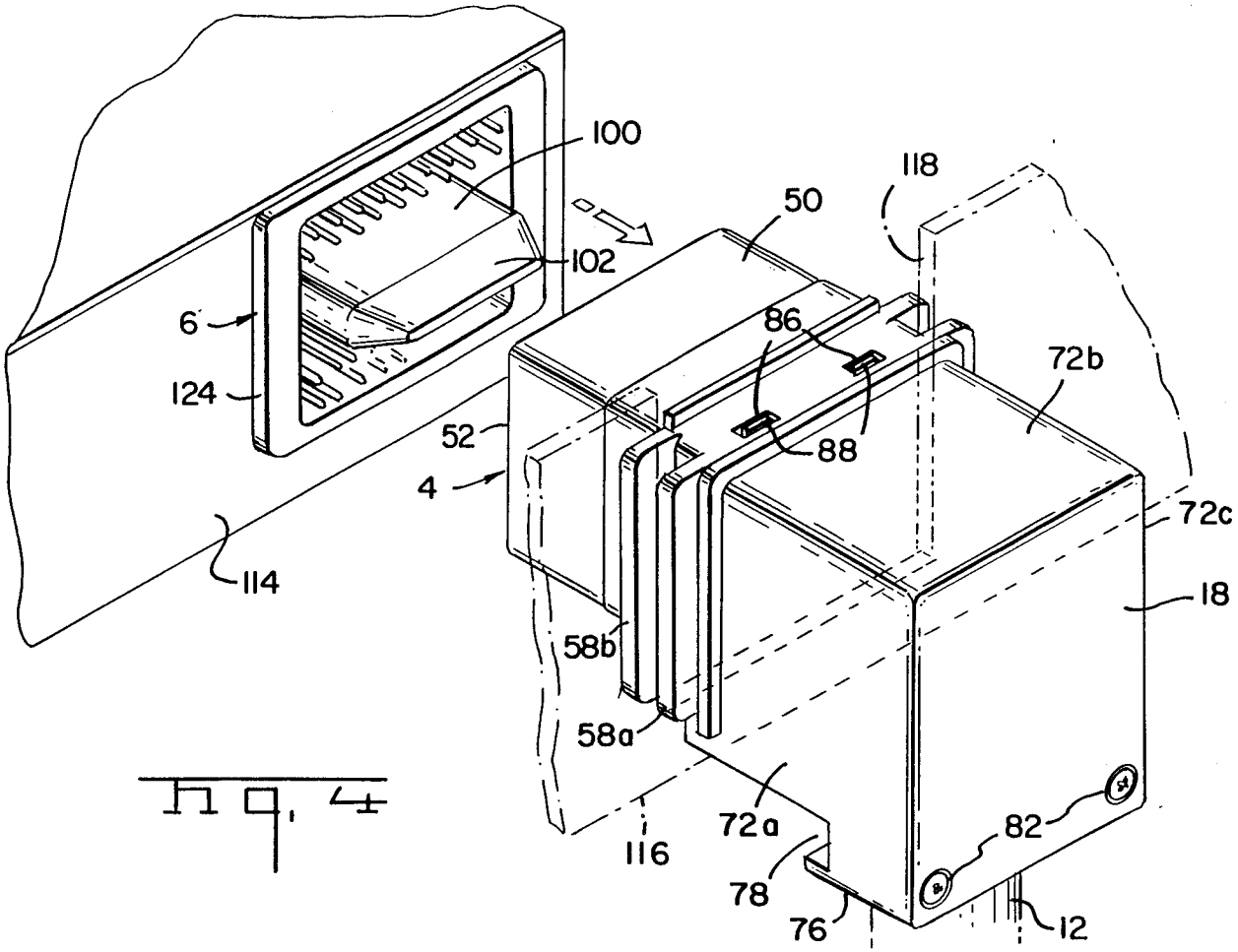
FIG. 4 is a perspective view showing the receptacle module with an outer cover assembled to the receptacle module, in which a header on an electrical component is oriented to mate with the receptacle modules and the multiconductor electrical terminals positioned therein.
Figure 7:
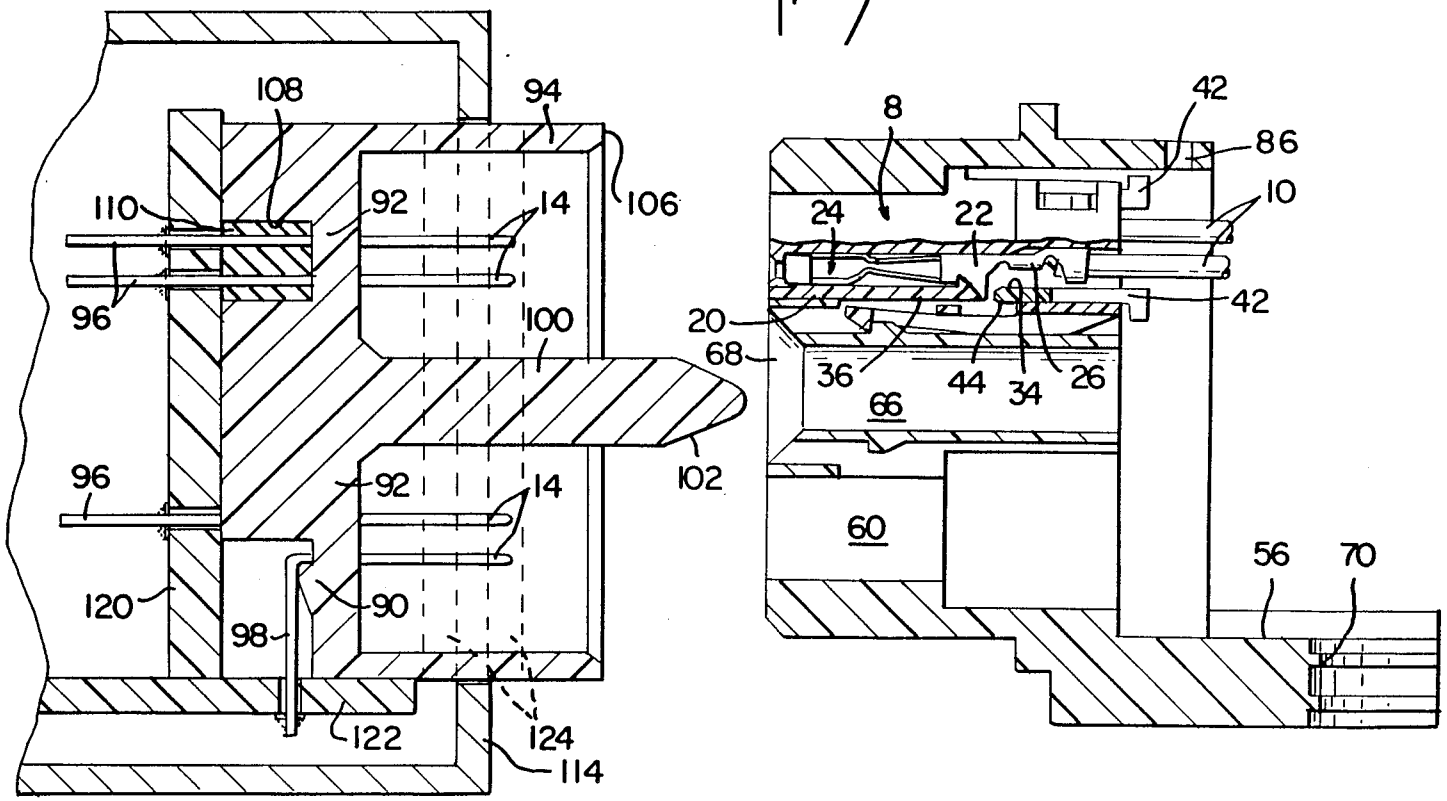
Figure 6:
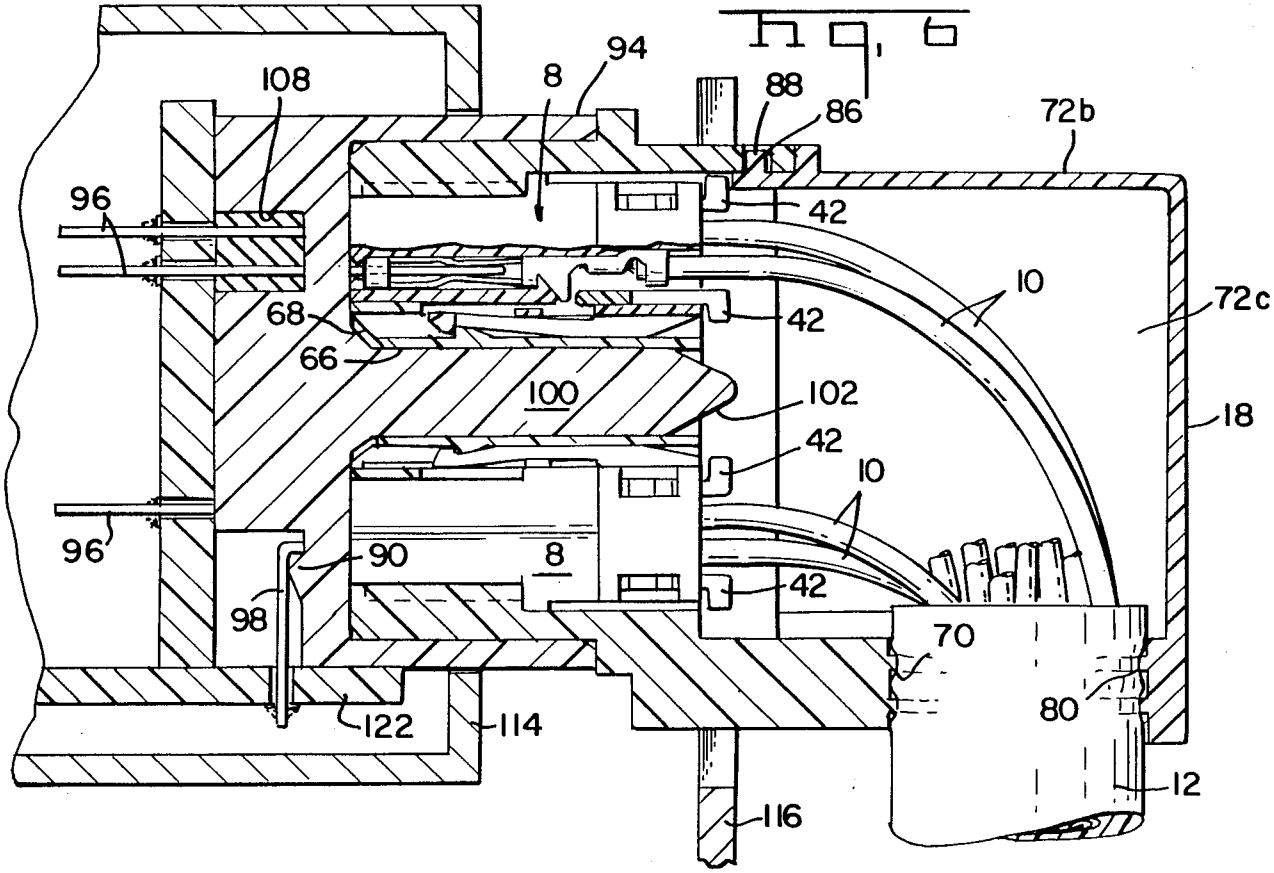
FIG. 6 is an assembled cross-sectional view showing the receptacle module, with electrical connectors mated to a header.
Figure 7:
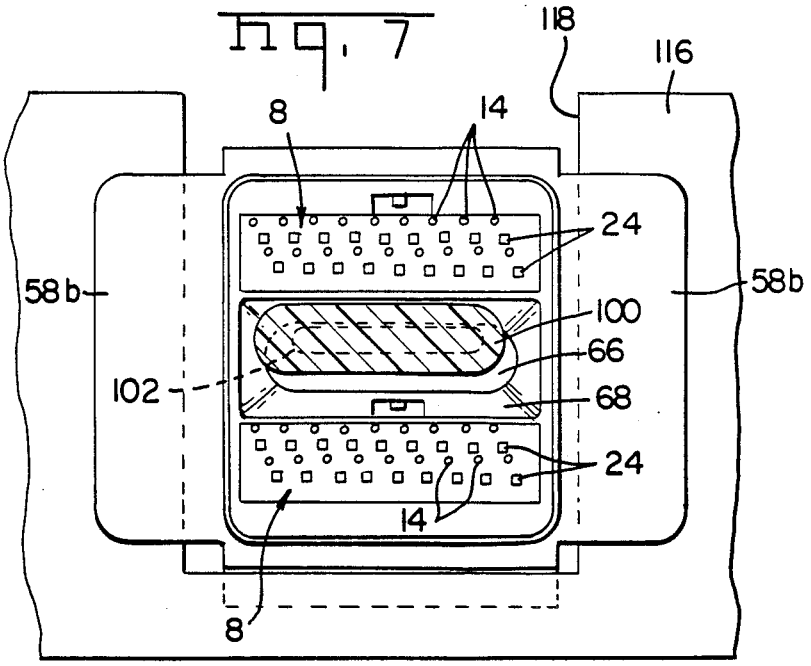
Figure 8:
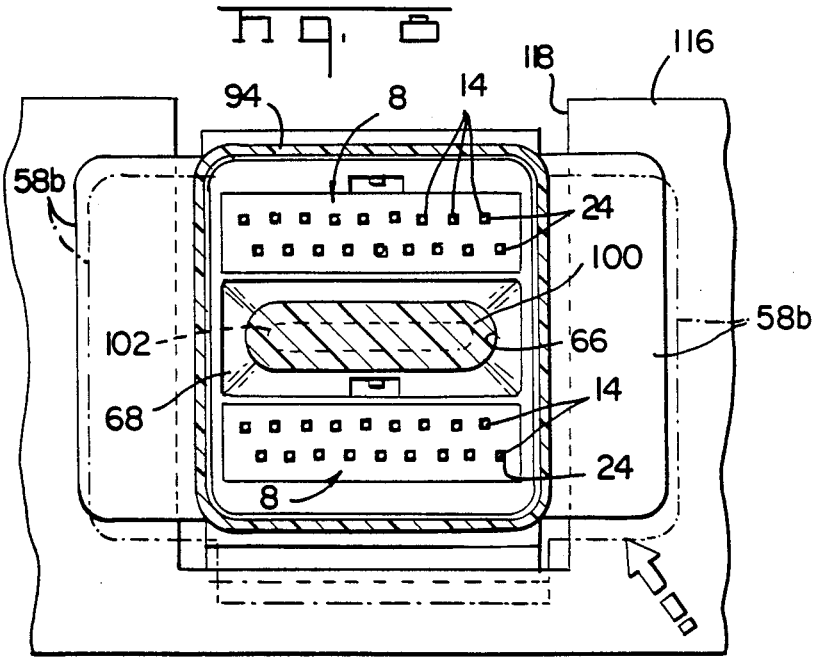
Figure 7:
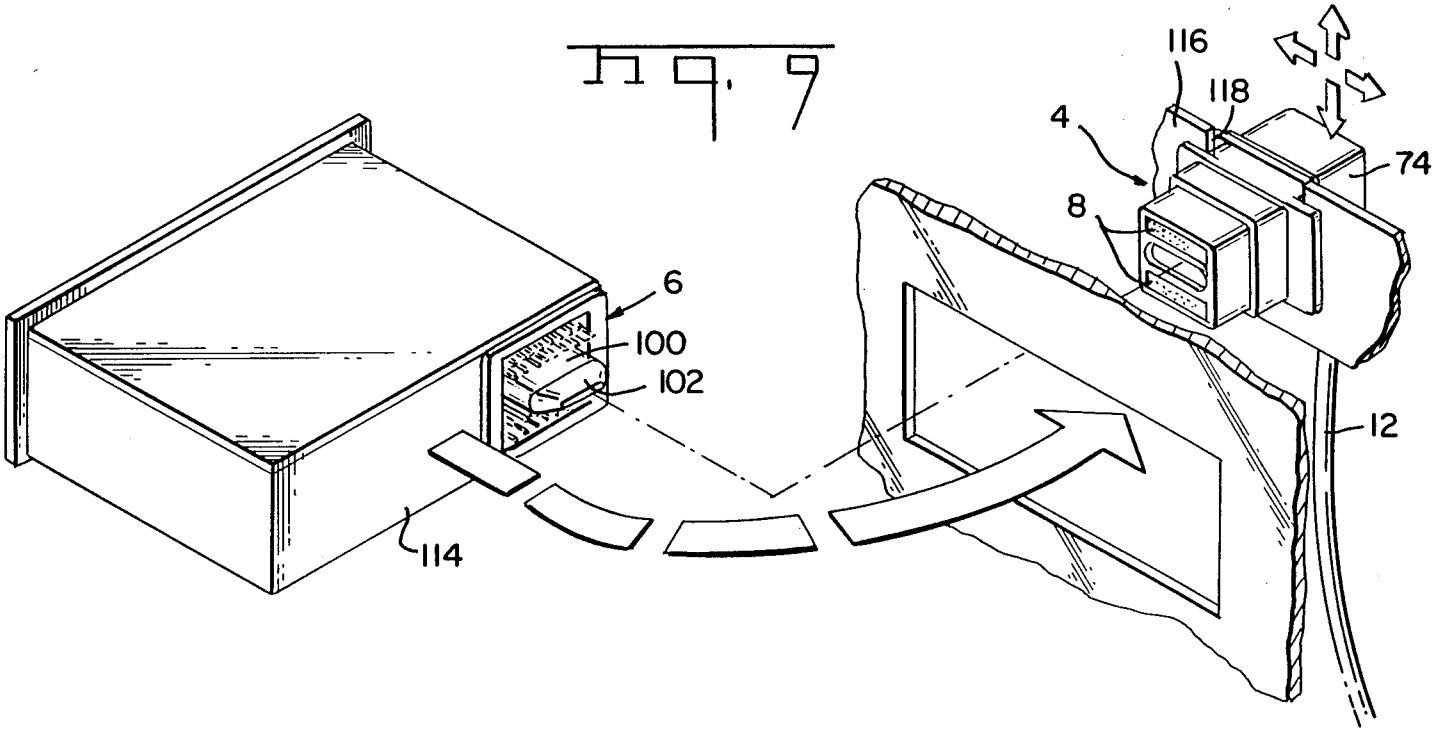

The input/output electrical connector assembly 2 comprising the preferred embodiment of this invention is specifically intended to enable blind assembly of an electrical component, such as a radio, to an electrical harness in an automobile. This electrical connector assembly 2 would permit robotic assembly of such a component. Preferably, robotic assembly is limited to straight line movement of the component during assembly operations.

The input/output electrical connector assembly 2 includes a receptacle module 4, a printed circuit board header 6, and two multiconductor electrical connectors 8 attached to wires 10 in a harness cable 12. Each multiconductor electrical connector 8 includes a connector housing 20 with a plurality of terminals 22 positioned therein. The terminals are the type suitable for mating with pins 14 in the header 6. After the connectors are attached to wires 10 in the harness cable 12 in a conventional manner, the connectors 8 can be positioned within the receptacle module 4 and a cover 18 can then be assembled around the rear of the receptacle module covering both the rear of the connectors 8 and the end of the cable 12. The receptacle module 4 can then be mounted in a panel or workpiece 16 in a position in which it can be mated with a header 6 on an electrical component with the electrical harness including cable 12 extending behind the panel 16.

The multiconductor electrical connectors 8 are of the type described more fully in U.S. patent application Ser. No. 873,652 filed June 12, 1986, now U.S. Pat. No. 4,722,704, incorporated herein by reference. Each of the terminals 22 located in the connector housing 20 is formed of a conventional spring metal and includes a plurality of receptacle contact beams 24 suitable for forming an electrically mated connection with the pins 14 in header 6. Each terminal includes a crimp 26 at its rear end, of conventional configuration, suitable for establishing electrical contact to the core of a conductor in each insulated wire 10. The terminals 22 are inserted in passages within the connector housing 20 from the rear. At least three surfaces are provided on each terminal for securing the terminal within the housing 20. A transverse edge 28 on a box section of the terminal is spaced from a pair of upstanding ears 30. Stop fingers 32 are provided on the front of the terminal to engage the front wall of the terminal cavities 34 when the terminals are inserted into the connector from the rear. Each housing 20 includes a resilient terminal latch finger 36 which extends from the front portion of the housing. One terminal latch finger 36 is located in each terminal cavity 34. As shown in FIG. 5, each terminal latch finger 36 engages a terminal in the corresponding cavity 34 between the transverse edge 28 and the upstanding ears 30. Transverse overstress members 38, located on the exterior of the housing, prevent damage to the terminal latch fingers 36. A secondary lock 42 can be inserted from the rear of the connector housing 20 into abutting engagement with the rear of the ears 30. Secondary lock fingers 44 engage openings 46 in the housing to secure the terminals within the connector housing 20. The connector retention latch 40, located on the exterior of the housing 20, has a transverse latch bar 48 located at the end of two flexible arms. When the connector housing 20 is mated with a matable connector, the transverse latch bar 48 would engage a corresponding protuberance on the mating connector. When used with the receptacle module 4 of the instant invention, the latch 40 and the transverse latch bar 48 serve to retain the multiconductor electrical connectors in the receptacle module 4.

The receptacle module 4 comprises a receptacle module housing 50, having a front face 52 and a rear face 54. A ledge 56 extends from one edge or side of the receptacle module from and beyond the rear face 54 of the receptacle module 4. A plurality of mounting flanges 58*a* and 58*b* are located on the exterior of the receptacle module to permit insertion of the module into a cutout in a panel 16. Adjacent mounting flanges 58*a* and 58*b* are spaced apart by a distance sufficient to receive the edges of panel 16 therebetween while still permitting at least limited movement of the receptacle module in any direction in the plane of panel 16.

Each receptacle module 4 includes upper and lower connector mounting cavities 60*a* and 60*b* extending through the receptacle module housing 50 from the front face 52 to the rear face 54. These connector mounting cavities 60*a* and 60*b* are each located above the rearwardly extending ledge 56. The connector mounting cavities 60*a* and 60*b* are each profiled to receive a single electrical connector 8, and the profile of the cavities can be configured to conform to the outer profile of the electrical connector housing 20. The conductor mounting cavities 60 are also configured to permit the connectors 8 to be inserted into the receptacle module 4 through the rear face 54. Each connector mounting cavity 60 includes connector latch relief grooves adapted to receive the arms on the connector latch 40 and an upstanding connector latch boss 62 between the grooves 64 adapted to engage the transverse latch bar 48. The rear of the connector latch boss 62 is inclined so that the transverse latch bar 48 will be deflected upwardly as the connector is inserted into a corresponding cavity 60 from the rear. The front of the connector latch boss 62 extends transversely to securely engage the transverse latch bar 48.

An alignment cavity 66 is located between the upper and lower connector mounting cavities 60. The alignment cavity 66 extends inwardly from the front face 52 and, in the preferred embodiment, alignment cavity 66 extends from the front face 52 to the rear face 54. Cavity 66 has an oblong configuration with a beveled lead-in surface 68 opening onto the exterior or front face 52. This beveled lead-in surface 68 extends around the complete periphery of alignment cavity 66.

Cover 18 is configured for assembly to the rear of the receptacle module housing 50 after connectors 8 with harness cable 12 attached thereto have been inserted into the receptacle module housing 50 through the rear face 54. Cover 18 has sidewalls 72*a*, 72*b* and 72*c* joined to a rear wall 74. A bottom shelf 76 extends from a lower edge of the rear wall 74 with a cutout 78 formed on the top of the bottom shelf 76. This cutout is dimensioned to receive the outer edge of the ledge 56. A semicircular recess 70 is formed on the edge of the ledge 56. A cooperating semicircular recess is formed on the bottom shelf 76 of the cover 18. When the cover 18 is attached to the rear of the receptacle module 4, the two semicircular recesses 70 and 80 together define a cable receiving aperture extending upwardly from the lower end of the rear of receptacle module 4. Projections 88 on the top sidewall 72b of cover 18 are dimensioned to fit within holes 86 on the top of the rear face 54 of the receptacle module housing 50. Aligned holes 82 and 84 are provided in the cover 18 and the free end of the receptacle module ledge 56 so that the cover 18 can be secured to the receptacle module housing 50 at the top and the bottom. In this manner, the cover 18 can be secured to the receptacle module housing from the top and rear after the connectors 8 have been inserted into the receptacle module 4. In the embodiment depicted herein, the harness cable 12 is bent in a right angle and extends from the bottom of the receptacle module. It should be understood that other configurations, in which the shelf 76 and the cable receiving aperture is located in other faces of both the cover 18 and the receptacle module 4, could be employed.

In the preferred embodiment of this invention, the printed circuit board header 6 comprises an insulative body 90 in which a plurality of electrically conductive pins 14 of the type suitable for receipt in through holes in a printed circuit board are aligned in separate rows. The inner and outer ends of the pins 14 protrude on opposite sides of an inner wall 92 on the header body 90. In the preferred embodiment of the invention, the inner ends of pins 14 extend outwardly beyond an inner side 104 of the header body 90. The outer ends of the pins 14 also protrude on the inner side 104 of the header body 90, but a header shroud 94 extends around the pins 14. In the preferred embodiment of this invention, the inner ends 96 of the portion of the pins 14 are straight. The inner end 98 of other pins extend at a right angle. In the preferred embodiment of this invention, one row of pins has inner ends 98 which extend at a right angle and the other three rows have pins with straight inner ends 96. The outer ends of the pins 14 are located in an ordered array corresponding essentially to the orientation of the terminals 22 of connectors 8. Thus, spacing and positioning of the outer ends of pins 14 will correspond to the spacing and positioning of the terminals 22 to permit the terminals 22 and pins 14 to be mated when the header 6 is mated to the receptacle module 4.

Header body 90 also includes an alignment post 100 having a generally oblong cross-section extending between the two inner rows of pins 14. The alignment post 100 has a tapered front 102 and the cross-section of alignment post 100 is dimensioned for receipt within the alignment cavity 66 on module housing 50. The taper extends completely around the periphery of the alignment post 100 at tapered front end 102. The centrally disposed oblong alignment post protrudes from the outer side of the header and the protruding free end of the alignment post 100 extends beyond the outer end of pins 14. A filter cavity 108 is defined on the inner side 104 of the header body 90. This filter cavity is suitable for receiving a filter 110 molded out of a ferrite material and having a plurality of holes 112 in a configuration suitable for insertion onto the inner ends of pins 14 in the upper two rows. This ferrite filter 110 comprises a filter of substantially conventional construction and operation.

The header 6 in the preferred embodiment of this invention provides a sufficient number of pins for all of the input or output lines for an electrical component, such as a radio which might be used in an automobile. Connection to the circuitry in the electrical component can be made through conventional printed circuit boards 120 and 122. Since the pins or posts 14 can be formed using a pre-tinned brass square wire with chamfer ends, a conventional through hole soldering technique can be employed to interconnect the posts or pins 14 to the circuitry on the printed circuit boards 120 and 122.

The header body 90 includes mounting flanges 124 at opposite sides of the outer side 106. These mounting flanges serve as means for establishing a fixed attachment of the header 6 to the casing 114 of an electrical component, such as a radio. The casing or cover 114 includes a slot 115 into which the header body 90 is inserted with the flanges 124 being located on opposite sides of the rear panel 114. The alignment post 110, which extends beyond the outer ends of the pins 14, also extends outwardly beyond the rear panel 114 of the electrical component, such as a radio.

The mounting flanges 58 on the receptacle module housing 50 serve as a means for attachment of the receptacle module 4 to the carrier panel or workpiece 116. Carrier panel 16 includes a slot 118 into which the receptacle module 4 can be inserted with the flanges 58 being on opposite sides of the panel 116. The harness cable 12 would extend behind the carrier panel 116 but the front face 52 of the receptacle module would be open through the slot 118. Interconnection of the electrical component to the harness cable 12 can then be easily attained by simply mating the header 6 to the receptacle module 4. Since the alignment post 100 protrudes from the outer side 106 of the header 6 and protrudes outwardly beyond the rear panel 114 of the electrical component, the alignment post 100 will be the first member to engage the receptacle module 4. Since the alignment cavity 66 is specifically configured to receive the alignment post 100, these members serve as first and second alignment means to ensure precise alignment between pins 14 and connector terminals 22. The tapered leading edge 102 of the alignment post 100 will be roughly aligned with the alignment cavity 66 and will engage the beveled lead-in portion 68 initially. Continued inward movement of the electrical component to which header 6 is attached will result in relative movement between the receptacle module 4 and the header 6 as the receptacle module 4 is free to move within slot 118 in any direction in the plane of the carrier panel 116. If the electrical component is robotically assembled, it would be anticipated that most of this movement would involve movement of the receptacle module 4 within the slot 118 in the carrier panel 16. Since the portion of the alignment post conforming to the contour of the inner surface of alignment cavity 66 extends outwardly beyond the outer ends of pins 14, the pins 14 and terminals 22 will be mutually aligned before engagement. Thus, the alignment post 100 mates with the alignment cavity 66 before the outer side 106 of header 6 mates with the front face 52 of the receptacle module and before the pins 14 engage the terminals 22. Since the alignment cavity 66 is open on the front face, the alignment post 100 is inserted through the front face into alignment cavity 66 just as the pins 14 are inserted through the front face 52 into engagement with the terminals 22.

In addition to permitting blind mate assembly of an electrical component to a harness, this connector also ensures that the signal lines, consisting of pins 14, terminals 22, and unshielded portions of wires 10 need not be subject to electrical interference. Normally, the majority of the pins 14 in the header 6 would be located on the interior of the body of the electrical components. Thus, the outer cover of the electrical component would provide shielding for pins 14. In the preferred embodiment of this invention, the receptacle module 4 and the cover 18 would provide shielding for the terminals 22 and unshielded portions of wires 10. The receptacle module housing 50 and the cover 18 could be molded out of a conventional insulative material and nickel plated, or it could be molded out of a nickel impregnated insulative material to provide adequate shielding requirements. In this manner, a blind mate robotic assembly of an electrical component to a wiring harness can be made while ensuring that adequate filtering and shielding is provided to preclude interference from affecting performance of the electrical components.

We claim:

1. An input/output electrical connector assembly for use in mounting an electrical component on a workpiece and interconnecting the electrical component to an electrical conductor harness having one or more multiconductor electrical connectors, each having a plurality of terminals attached to electrical conductors in the harness, the assembly comprising:

a header including a plurality of electrically conductive pins and an insulative body, rear ends of the pins being insertable into apertures in a panel, the pins being mounted in the body in an ordered array corresponding to the orientation of the terminals in the one or more electrical connectors, the header including at least one alignment post protruding from the body beyond the pins, the header further including means for attachment to the electrical component; and a receptacle module having front and rear faces with one or more connector mounting cavities extending between the front and rear faces, each connector mounting cavity receiving one of the electrical connectors upon insertion thereof through the rear face, and means on the receptacle module for mounting the receptacle module on the workpiece, the receptacle module having at least one alignment cavity extending inwardly from the front face for receiving each said alignment post upon insertion through the front face, whereby the electrical component can be connected to the conductors in the harness by mating the header to the receptacle module.

2. The assembly of claim 1 wherein the pins are aligned in rows and extend through the insulative body of the header protruding beyond an outer side and an opposite inner side thereof.

3. The assembly of claim 2 wherein the at least one alignment post protrudes from the outer side of the insulative body.

4. The assembly of claim 3 wherein a single said alignment post comprises an oblong member centrally disposed on the header.

5. The assembly of claim 4 wherein the single alignment post extends between separate rows of pins protruding from the outer side of the insulative body.

6. The assembly of claim 5 wherein a single said alignment cavity extends between said connector mounting cavities located above and below the single alignment cavity.

7. The assembly of claim 6 wherein the single alignment cavity extends between the front and rear faces of the receptacle module.

8. The assembly of claim 7 further comprising a cover attachable to the rear face of the receptacle module after insertion of the electrical connectors into the connector mounting cavities.

9. The assembly of claim 8 wherein a ledge projects from one side of the receptacle module beyond the rear face, a recess being located on the edge of the ledge, the cover also having a cooperating recess, the recesses forming a cable receiving aperture when the cover is attached to the receptacle module.

10. The assembly of claim 2 wherein an electrical filter is mounted on an inner end of the pins projecting from the inner side of the header.

11. The assembly of claim 1 wherein the receptacle module defines a shielding envelope partially surrounding each electrical connector located in a said connector mounting cavity.

12. The assembly of claim 11 wherein the receptacle module is plated with a material having electromagnetic shielding properties.

13. The assembly of claim 11 wherein the receptacle module is molded from an insulative material impregnated with material having electromagnetic shielding properties.

14. The assembly of claim 11 further comprising a cover attachable to the rear face of the receptacle module, the cover and the receptacle module together forming a shielding envelope partially surrounding each electrical connector located in a connector mounting cavity.

15. The assembly of claim 1 wherein the workpiece comprises a panel and the means for mounting the receptacle module on the workpiece comprises means for mounting the receptacle module on the panel.

16. The assembly of claim 15 wherein the means for mounting the receptacle module on the panel comprises means for permitting limited movement of the receptacle module in any direction in the plane of the panel.

17. The assembly of claim 1 wherein the workpiece comprises a panel and the means for mounting the receptacle module in the workpiece comprises means for mounting the receptacle module in a slot in the panel.

18. The assembly of claim 17 wherein the means for mounting the receptacle module in the panel comprises mounting flanges extending from the exterior of the receptacle module, adjacent mounting flanges being spaced apart by a distance sufficient to receive the panel therebetween to permit at least limited movement of the receptacle module relative to the panel during mating of the header to the receptacle module.

19. The assembly of claim 1 wherein the alignment post is tapered from the end protruding from the header body and the alignment cavity is beveled on the front face of the receptacle module.

20. The assembly of claim 1 wherein the alignment post is tapered around the complete periphery thereof and the alignment cavity is beveled around the complete periphery thereof, the means for mounting the receptacle module on the workpiece comprising means permitting at least limited movement of the receptacle module in any direction in a plane perpendicular to the alignment post.

21. An assembly for mounting an electrical component on a panel and connecting the electrical component to electrical conductors behind the panel upon movement of the electrical component in a straight line toward the panel, the assembly comprising:

a first housing fixedly attachable to the electrical component and a second housing mountable on the panel for at least limited movement in any direction in the plane of the panel;

a plurality of first terminals mounted in the first housing;

at least one electrical connector containing a plurality of second terminals attachable to the electrical conductors and matable with the first terminals, the electrical connector being attachable to the second housing;

mating alignment means on the first and second housings including an alignment post and an alignment cavity, the alignment post being insertable into the alignment cavity through a front end thereof, a protruding end of the alignment post being tapered around the periphery thereof and the alignment cavity being beveled around the front end so that the housing containing the cavity can move in any direction in the plane of the panel when the tapered protruding end of the alignment post engages the beveled front end of the alignment cavity to align the first terminals with the second terminals during movement of the electrical component toward the panel before mating of the first terminals to the second terminals; and wherein the first housing comprises a printed circuit board header and the first terminals comprise pins whose rear ends are insertable into through holes on the printed circuit board.

22. The assembly of claim 21 wherein the alignment post is on the first housing and the alignment cavity is in the second housing.

23. A blind mate input/output electrical connector assembly for mounting an electrical component on a panel in an automobile and for electrically interconnecting the electrical component to an electrical conductor harness extending behind the panel, the connector assembly comprising:

circuit board means in the electrical component;

a header including a plurality of pins protruding through an insulative body, each pin having an inner end attached to the circuit board means in the electrical component and an outer end projecting beyond an outer side of the insulative body and first alignment means located on the outer side of the header;

at least one electrical connector having a plurality of terminals attached to electrical conductors in the harness;

a receptacle module having a front face and a rear face, and having means for mounting each electrical connector therein upon insertion of the electrical connector into the receptacle module through a rear face thereof, and a second alignment means, the first alignment means being matable with the second alignment means and the pins being matable with the terminals in each electrical connector when the header is mated with the receptacle module along the outer side of the header and the front face of the receptacle module.

24. The assembly of claim 23 wherein the first alignment means comprises an alignment post protruding beyond the outer side of the header and the second alignment means comprises an alignment cavity extending into the receptacle module through the front face.

25. The assembly of claim 24 wherein the alignment post projects beyond the outer ends of the pins, the alignment post being at least partially received in the alignment cavity to align the pins with corresponding terminals before engagement thereof.

26. The assembly of claim 25 wherein the means for mounting each electrical connector comprises a connector mounting cavity extending between the front and rear face of the receptacle module, each cavity conforming to the outer profile of each electrical connector.

27. The assembly of claim 26 comprising two connector mounting cavities above and below the alignment cavity and the alignment post extend between rows of pins on the header.

28. The assembly of claim 23 wherein the receptacle module defines a shielding envelope partially surrounding each electrical connector.

29. The assembly of claim 28 further comprising a filter mounted on the inner ends of the pins.

* * * * *